US010868377B2

(12) United States Patent
Lybrand

(10) Patent No.: US 10,868,377 B2
(45) Date of Patent: Dec. 15, 2020

(54) ELECTRICAL SPRING CONTACT WITH INTEGRATED EXTENDING CARRIER PORTION

(71) Applicant: AVX Corporation, Fountain Inn, SC (US)

(72) Inventor: Brent B. Lybrand, Fountain Inn, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/547,920

(22) Filed: Aug. 22, 2019

(65) Prior Publication Data

US 2020/0076101 A1 Mar. 5, 2020

Related U.S. Application Data

(60) Provisional application No. 62/724,395, filed on Aug. 29, 2018.

(51) Int. Cl.
*H01R 12/71* (2011.01)
*H01R 13/24* (2006.01)

(52) U.S. Cl.
CPC ..... *H01R 12/714* (2013.01); *H01R 13/2442* (2013.01); *H01R 13/2464* (2013.01)

(58) Field of Classification Search
CPC .... H01R 12/52; H01R 12/526; H01R 12/714; H01R 13/2442; H01R 13/2464
USPC ..... 439/81; 174/355
See application file for complete search history.

(56) References Cited

U.S. PATENT DOCUMENTS 6,142,790 A * 11/2000 Niitsu ..... H01R 12/592 439/495
6,287,151 B1 * 9/2001 Matsuzaki ..... H01R 43/205 439/630
6,293,805 B1 * 9/2001 Wu ..... G06K 7/0021 439/66
6,551,149 B2 * 4/2003 Orihara ..... H01R 13/2442 439/83
6,625,881 B2 * 9/2003 Ammar ..... H01R 12/714 29/830
6,674,018 B2 * 1/2004 Yumi ..... H05K 1/0215 174/261
6,719,594 B1 * 4/2004 Yuzawa ..... G06K 7/0021 439/66

(Continued)

FOREIGN PATENT DOCUMENTS

KR 10-2017-0139550 A 12/2017

OTHER PUBLICATIONS

International Search Report and Written Opinion in PCT/IB2019/057088 dated Dec. 27, 2019 (12 pages).

*Primary Examiner* — Peter G Leigh
(74) *Attorney, Agent, or Firm* — Foley & Lardner LLP

(57) ABSTRACT

An electrical spring contact is provided. The electrical spring contact includes a connection portion configured to couple the electrical spring contact to a printed circuit board, a bulge portion, a bend portion having a substantially U-shaped configuration, and an inclined portion extending from the bend portion at an angle relative to a plane that is substantially parallel to the connection portion. The connection portion, the bulge portion, the bend portion, and the inclined portion are formed from a single conductive contact material.

17 Claims, 13 Drawing Sheets

(56) References Cited

U.S. PATENT DOCUMENTS

| | | | | |
|---|---|---|---|---|
| 6,814,587 | B2 * | 11/2004 | Ma | H01R 9/096 439/66 |
| 7,481,686 | B2 * | 1/2009 | Uchida | G06K 7/0021 439/630 |
| 7,614,883 | B2 * | 11/2009 | Mendenhall | H01R 13/2435 439/66 |
| 8,517,780 | B2 * | 8/2013 | Yu | H01R 12/57 439/862 |
| 8,933,346 | B1 * | 1/2015 | Kramer | G06F 1/182 174/355 |
| 2004/0067663 | A1 | 4/2004 | Ammar et al. | |
| 2009/0191740 | A1 | 7/2009 | Aekins | |
| 2009/0227132 | A1 | 9/2009 | Bethurum et al. | |
| 2010/0041250 | A1 | 2/2010 | Hetzer et al. | |

* cited by examiner

ELECTRICAL SPRING CONTACT WITH INTEGRATED EXTENDING CARRIER PORTION

CROSS-REFERENCE TO RELATED APPLICATIONS

This application claims priority to U.S. Provisional Patent Application No. 62/724,395, filed Aug. 29, 2018, the entire disclosure of which is incorporated herein by reference in its entirety, for any and all purposes.

FIELD

The present application relates generally to electrical contacts, and more particularly to a type of electrical spring contact that may be used in a wire termination, grounding, or shielding application.

BACKGROUND

The following description is provided to assist the understanding of the reader. None of the information provided or references cited are admitted to be prior art.

Spring contacts, which may be alternatively referred to as spring fingers, shield fingers, or grounding springs, are used in a variety of applications that require small printed circuit boards (PCBs) including consumer electronics, industrial and automotive equipment, and medical devices. Individual spring contacts may be used for low voltage electrical connections. When mounted in a row, spring contacts can provide PCB grounding and shielding against EMI noise. Thus, an efficient and reliable spring contact that can be surface mounted on a PCB is needed.

SUMMARY

The systems, methods, and devices of this disclosure each have several innovative aspects, no single one of which is solely responsible for the desirable attributes disclosed herein. One embodiment of the invention relates to an electrical spring contact. The electrical spring contact includes a connection portion configured to couple the electrical spring contact to a printed circuit board, a bulge portion, a bend portion having a substantially U-shaped configuration, and an inclined portion extending from the bend portion at an angle relative to a plane that is substantially parallel to the connection portion. The connection portion, the bulge portion, the bend portion, and the inclined portion are formed from a single conductive contact material.

In an embodiment, the spring contact includes a hooked portion extending vertically from the connection portion.

In another embodiment, the inclined portion terminates in a forked end configured to receive a single wire termination.

In an embodiment, the single conductive contact material comprises beryllium copper. Further, in an embodiment, the single conductive contact material has a nominal thickness of 0.15 mm.

In an embodiment, the inclined portion tapers such that a width of the inclined portion decreases as it extends from the bend to a distal end.

Another embodiment of the invention relates to an electrical spring contact strip. The electrical spring contact strip includes multiple electrical spring contacts. Each electrical spring contact includes a connection portion configured to couple the electrical spring contact to a printed circuit board, a bulge portion, a bend portion having a substantially U-shaped configuration, and an inclined portion extending from the bend portion at an angle relative to a plane that is substantially parallel to the connection portion. The electrical spring contact strip further includes an integral carrier portion that is detachably coupled to the electrical spring contacts.

In an embodiment, each spring contact further comprises a hooked portion extending vertically from the connection portion. In such an embodiment, the integral carrier portion extends toward the inclined portions electrical spring contacts. In other embodiments, the integral carrier portion extends away from the inclined portions of the electrical spring contacts.

In an embodiment, the integral carrier portion and the solder joint portions of the electrical spring contacts are situated in a common plane. In such an embodiment, the electrical spring contact strip further includes a tip protection portion extending vertically from the integral carrier portion.

In another embodiment, the inclined portion terminates in a forked end configured to receive a single wire termination.

In an embodiment, the electrical spring contacts and the integral carrier portion are fabricated from a single conductive contact material. In such an embodiment, the single conductive contact material comprises beryllium copper. In another embodiment, the single conductive contact material has a nominal thickness of 0.15 mm.

In an embodiment, the electrical spring contact strip includes four electrical spring contacts.

In an embodiment, the inclined portion tapers such that a width of the inclined portion decreases as it extends from the bend portion to a distal end.

In an embodiment, electrical spring contact strip comprises a first plurality of electrical spring contacts detachably connected to a first side of the integral carrier portion and a second plurality of electrical spring contacts detachably connected to a second side of the integral carrier portion, and wherein the first plurality of electrical spring contacts mirrors the second plurality of electrical spring contacts across the integral carrier portion.

A system includes a printed circuit board and multiple electrical spring contacts. Each electrical spring contact includes a connection portion configured to couple the electrical spring contact to a printed circuit board, a bulge portion, a bend portion having a substantially U-shaped configuration, and an inclined portion extending from the bend portion at an angle relative to a plane that is substantially parallel to the connection portion. The connection portion, the bulge portion, the bend portion, and the inclined portion are formed from a single conductive contact material.

In an embodiment, the system includes an integral carrier portion that is detachably coupled to the multiple electrical spring contacts. The integral carrier portion is configured to be detached from the electrical spring contacts upon completion of a solder reflow process. In such an embodiment, the integral carrier portion extends toward the inclined portions of the electrical spring contacts. In another embodiment, the integral carrier portion extends away from the inclined portions of the electrical spring contacts. In yet another embodiment, a first plurality of electrical spring contacts is detachably connected to a first side of the integral carrier portion and a second plurality of electrical spring contacts detachably connected to a second side of the integral carrier portion, and wherein the first plurality of electrical spring contacts mirrors the second plurality of electrical spring contacts across the integral carrier portion.

In an embodiment, the inclined portion on each spring contact in the system tapers such that a width of the inclined portion decreases as it extends from the bend portion to a forked end.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein are embodiments of a spring contact with an integral carrier. The spring contact may be utilized to connect a discrete wire to a printed circuit board (PCB), or it may be used in grounding or shielding applications. The spring contacts may be packaged as strip including multiple individual contacts, and located on a PCB using automatic pick and place equipment. The inclusion of the integral carrier permits many contacts to be placed at once, and allows the contacts to be located precisely relative to each other on the PCB. Once a solder reflow process is completed and the contacts are securely attached to the PCB, the integral carrier may be detached (i.e., broken away), resulting in individual spring contacts separately coupled to the PCB.

Figure 1:
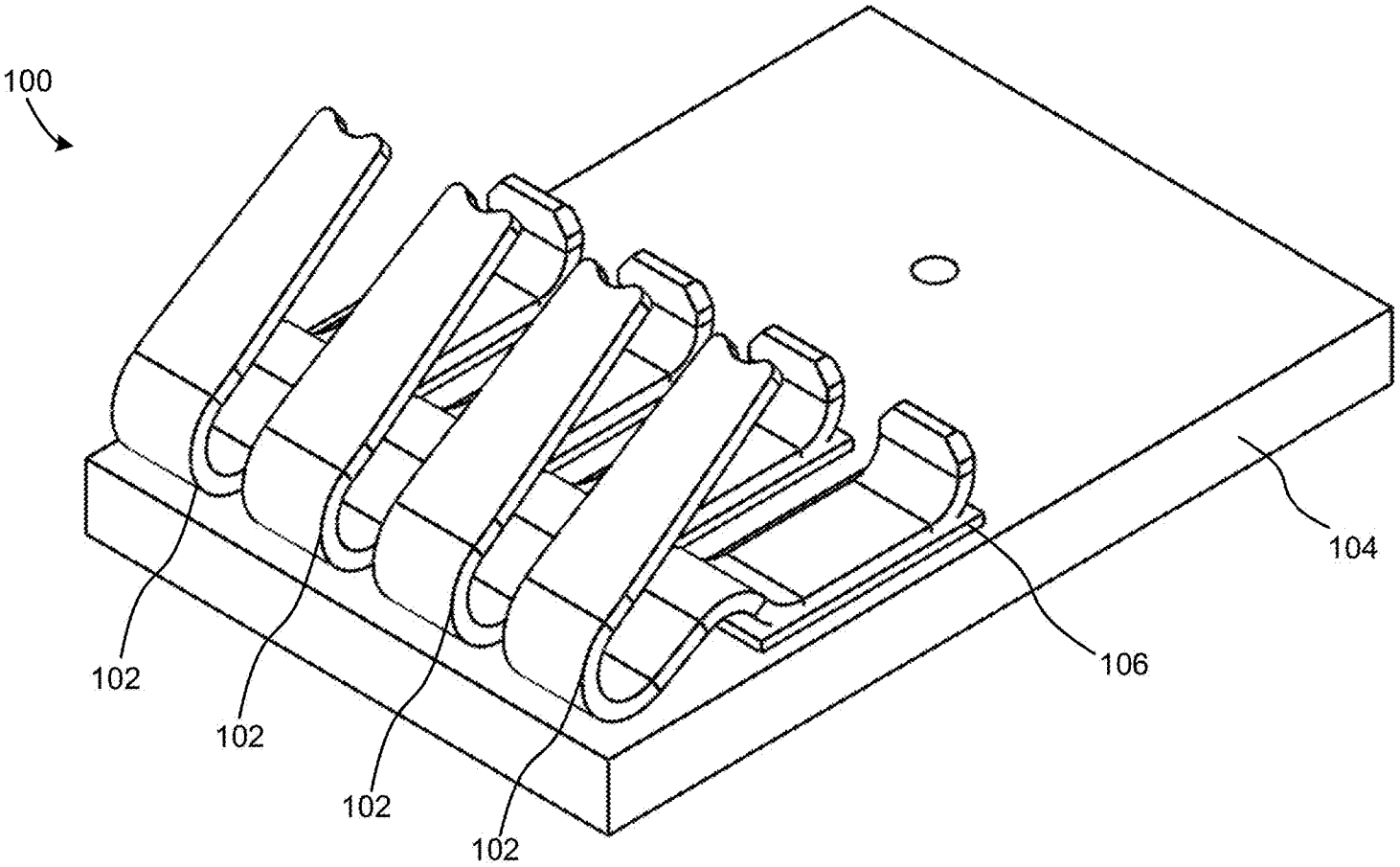
FIG. 1 depicts a perspective view of a spring contact in accordance with an illustrative embodiment.

Referring to FIG. 1, a mounted spring contact assembly 100 is depicted, according to an illustrative embodiment. The mounted spring contact assembly 100 includes multiple spring contacts 102. Although FIG. 1 depicts four spring contacts 102 mounted proximate each other, spring contact assembly 100 may have any number of spring contacts 102, including a single spring contact 102. The spring contacts 102 are shown to be mounted on a PCB 104 through multiple solder pads 106. The PCB 104 may be fabricated from any suitable material (e.g., FR4) and may be any required number of layers. The solder pads 106 may have a substantially rectangular shape and may be formed using a layer of solder paste. The solder paste may be a mixture of powdered solder and flux that is configured to melt under a controlled heating process to permanently join the spring contacts 102 to the PCB 104.

Figure 2B:
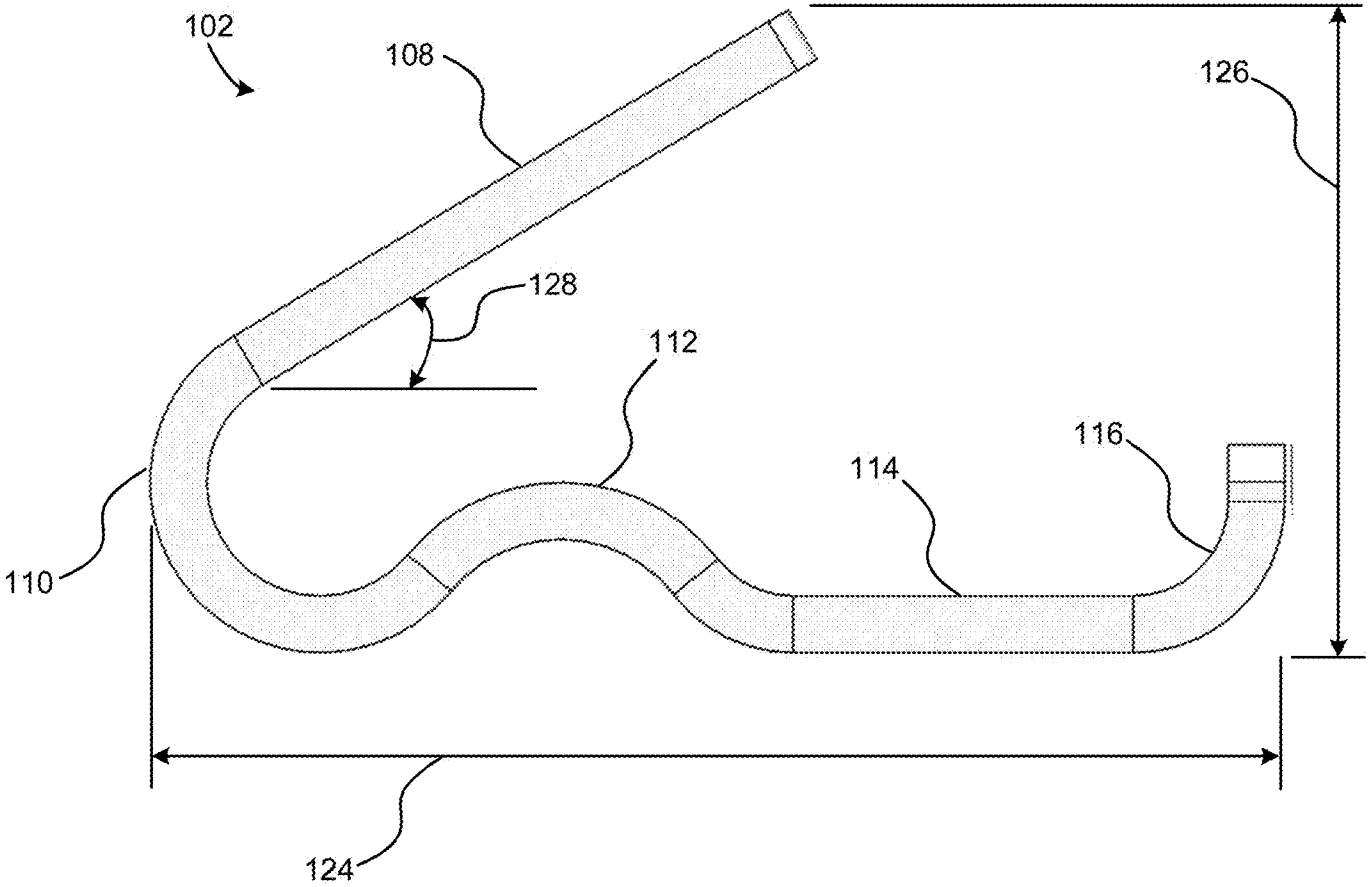
FIG. 2B depicts a side view of a spring contact in accordance with an illustrative embodiment.
Figure 2A:
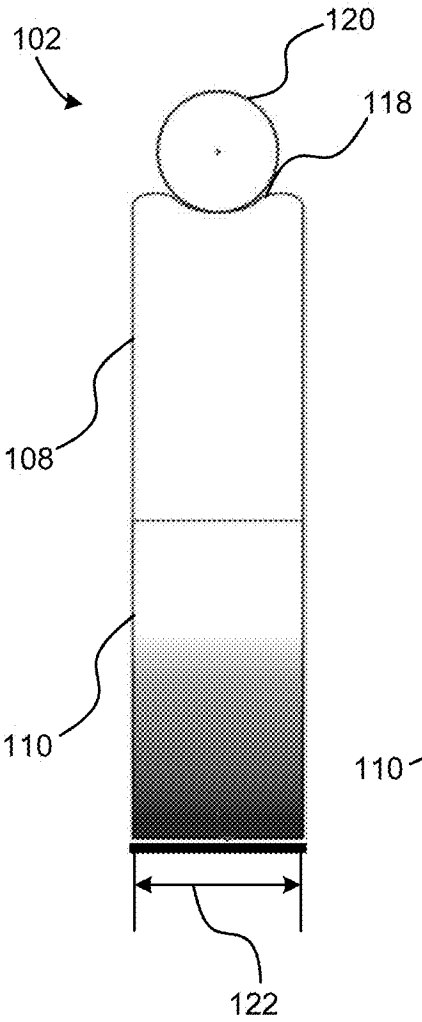
FIG. 2A depicts a front view of a spring contact in accordance with an illustrative embodiment.

Turning now to FIGS. 2A and 2B, front and side views of the spring contact 102 are depicted, according to some embodiments. As shown, the spring contact 102 is formed as a single component and includes an inclined portion 108, a bend portion 110, a bulge portion 112, a connection portion 114, and a hooked portion 116. The inclined portion 108 may extend at an angle 128 relative to a horizontal plane (e.g., a plane parallel to the connection portion 114). For example, angle 128 may be approximately 30 degrees, although angle 128 may be any dimension required to achieve desired deflection characteristics of the inclined portion 108. Connection portion 114 may be a portion used for a solder joint connection or any other electrical connection to an electrical pad or other electrical component to which the spring contact 102 is electrically coupled. The bend portion 110 may be substantially U-shaped and may be configured to permit the inclined portion 108 to deflect toward the bulge portion 112 and the connection portion 114 upon application of a force to the including portion 108. Upon removal of the force, the inclined portion 108 may snap back to its original position.

Bulge portion 112 may comprise a curved or "hump" shape that prevents solder from wicking into the bend portion 110. Limiting the wicking of solder into the bend portion 110 prevents the solder from reducing the effective beam length of the inclined portion 108 and bend portion 110. In various embodiments, the connection portion 114 provides a contact point to connect the spring contact 102 to the PCB 104. Connection portion 114 may be any shape or dimensions required to securely fasten the spring contact 102 to the PCB 104. Hooked portion 116 may extend in a vertical direction from the connection portion 114. Among other advantages, the presence of the hooked portion 116 results in a better solder fillet between the solder pad 106 and the connection portion 114, and prevents solder from wicking into unwanted areas.

Opposite the hooked portion 116, the inclined portion 108 is shown to terminate in a forked end 118. In various embodiments, the forked end 118 may by any concave recess that is configured to receive a wire termination 120. The wire may be a stranded or solid core wire having a core surrounded by insulation material, although the wire termination 120 must be stripped of insulation material in the area of the forked end 118 in order for the wire termination 120 to make electrical contact with the spring contact 102. For example, the single wire termination 120 may be a 28 AWG solid wire. In some embodiments, the dimensions of the forked end 118 (e.g., the radii of curvature for the curved surfaces comprising the forked end 118) may vary to facilitate use with any type or size of wire. Similarly, the spring contact 102 may be any dimensions required to suit the needs of the application in which the spring contact 102 is installed. In some embodiments, the width 122 of the spring contact 102 is nominally 0.45 mm, the depth 124 is nominally 3.0 mm, and the height 126 is nominally 1.7 mm.

Figure 3B:
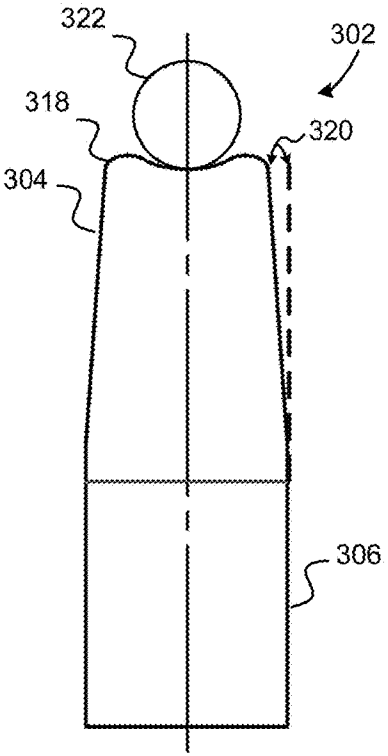
FIG. 3B depicts a front view of a spring contact in accordance with an illustrative embodiment.
Figure 3A:
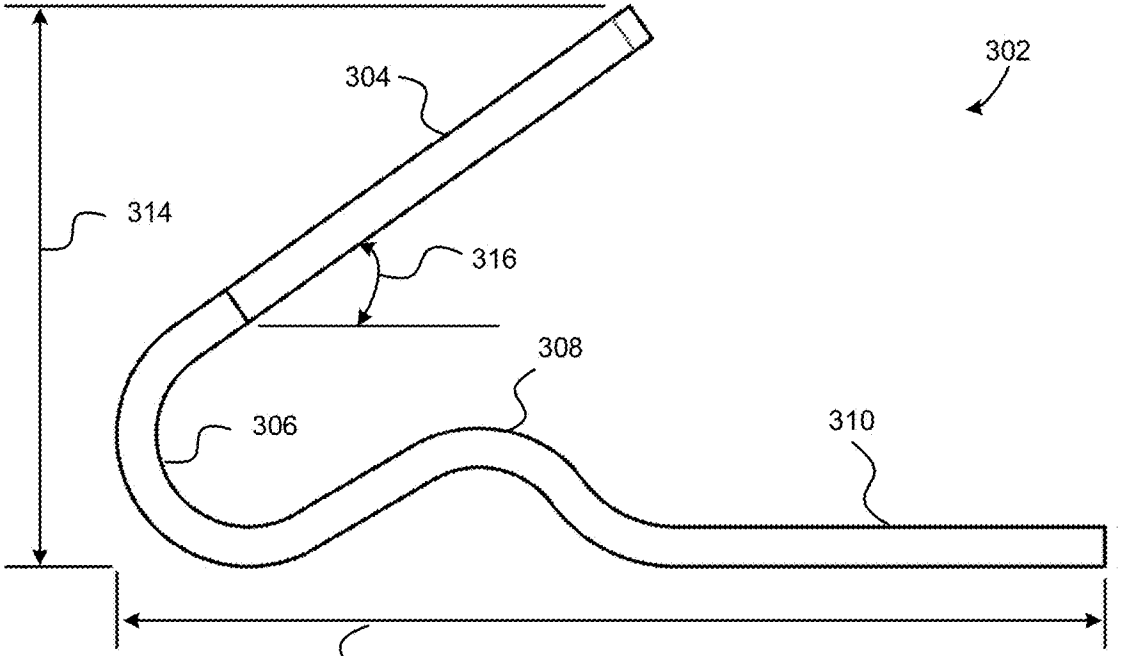
FIG. 3A depicts a side view of a spring contact in accordance with an illustrative embodiment.
Figure 3C:
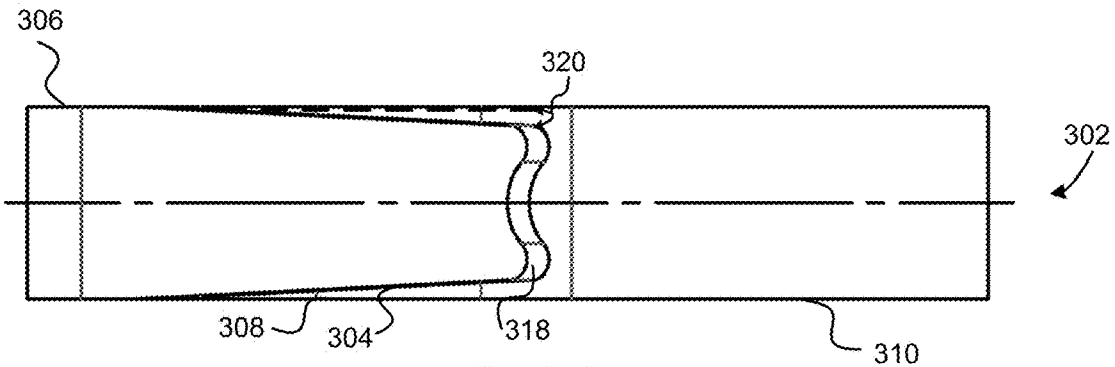
FIG. 3C depicts a top view of a spring contact in accordance with an illustrative embodiment.

In FIGS. 3A, 3B, and 3C, the side, front, and top views of a spring contact 302 are depicted, according to various embodiments. As shown, the spring contact 302 is formed as a single component and includes an inclined portion 304, a bend portion 306, a bulge portion 308, and a connection portion 310. Spring contact 302 does not include a hooked portion such as hooked portion 116 of spring contact 102. The absence of a hooked portion results in a simpler stamping process that requires less material than spring contact 102. Connection portion 310 may be a portion used for a solder joint connection or any other electrical connection to an electrical pad or other electrical component to which the spring contact 302 is electrically coupled. The bend portion 306 may be substantially U-shaped and may be configured to permit the inclined portion 304 to deflect toward the bulge portion 308 and the connection portion 310 upon application of a force to the inclined portion 304. Upon removal of the force, the inclined portion 304 may snap back to its original position. The inclined portion 304 may extend at an angle 316 relative to a horizontal plane (e.g., a plane parallel to the connection portion 310). For example, angle 316 may be approximately 30 degrees, although angle 316 may be any dimension required to achieve desired deflection characteristics of the inclined portion 304. Inclined portion 304 may be tapered at an angle 320 within the plane of the inclined portion and relative to the center axis of the inclined portion such that the width of the incline portion decreases as it extends distally from the bend portion 306 to a forked end 318. The tapered design of inclined portion 304 facilitates more advantageous stress distribution along the length of the spring contact when force is applied to the inclined portion 304. Advantageous stress distribution along the spring contact will contribute to decreased likelihood of spring contact failure in any individual use and repeated uses of the spring contact, thus increasing the spring contact fatigue life.

Figure 4:
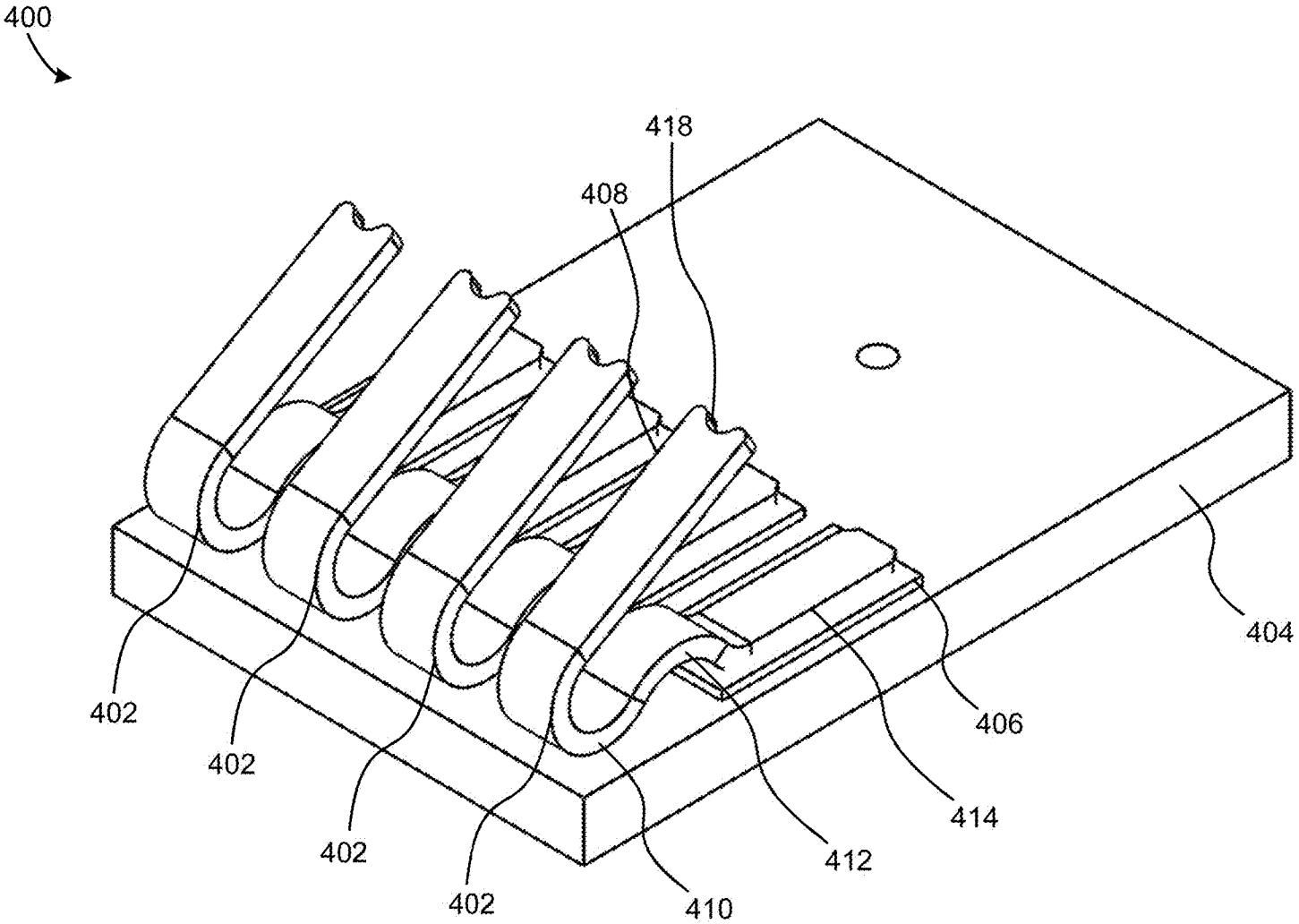
FIG. 4 depicts a perspective view of a spring contact in accordance with another illustrative embodiment.

Referring now to FIG. 4, another embodiment of a mounted spring contact assembly 400 is depicted. Similar to contact assembly 100 depicted above in FIG. 1, contact assembly 400 is shown to include multiple spring contacts 402 mounted on a PCB 404 using solder pads 406. Each spring contact 402 is shown to include an inclined portion 408, a bend portion 410, a bulge portion 412, and a connection portion 414. However, spring contact 402 does not include an equivalent to hooked portion 116 of spring contact 102. The absence of a hooked portion results in a simpler stamping process that requires less material than spring contact 102. In addition, it is easier to keep a strip of contacts 402 (described in further detail in FIGS. 9-11 below) flat and straight during the installation process.

Both spring contacts 102 and 402 are single element contacts in that they may be formed from a single conductive contact element (i.e., any suitable conductive material). In some embodiments, the spring contacts 102 and 402 are fabricated from beryllium copper (BeCu). Among other desirable properties, BeCu may be selected for its high deflection range and good fatigue resistance. In other embodiments, another conductive material (e.g., brass, phosphor bronze) may be used to fabricate spring contacts 102 and 402.

Figure 5:
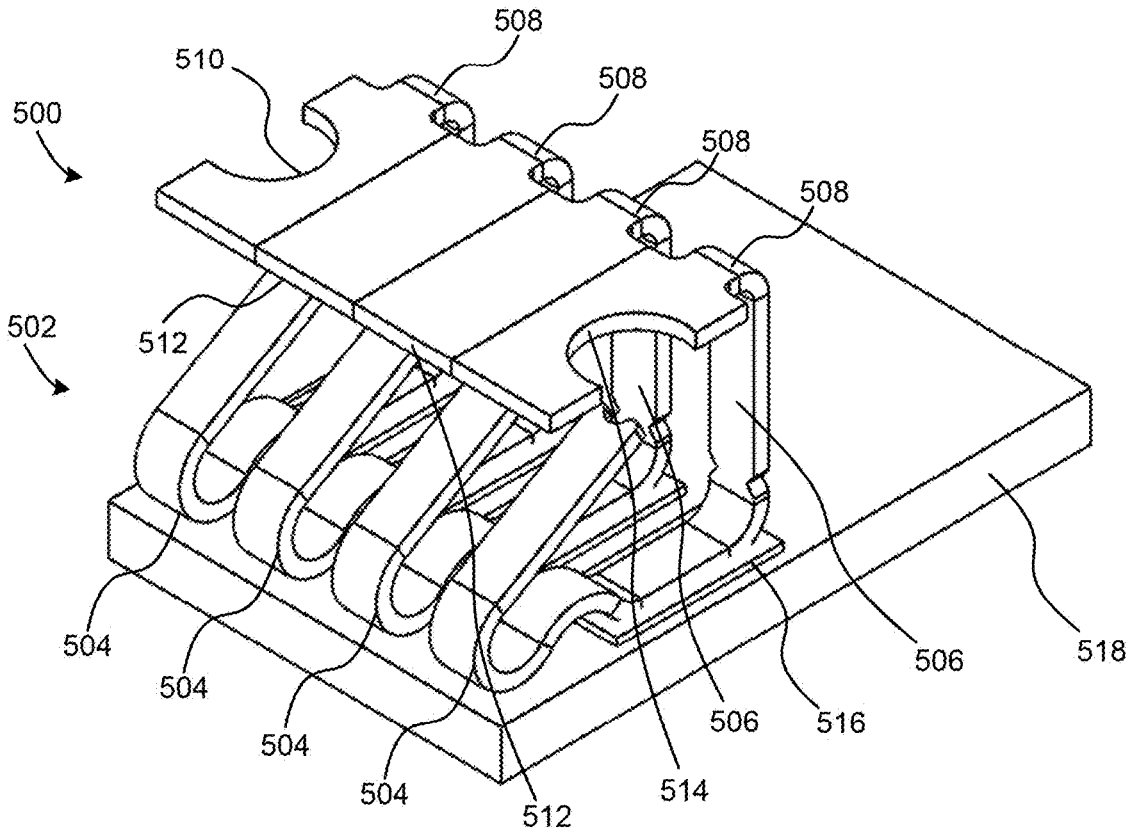
FIG. 5 depicts a perspective view of a mounted spring contact in accordance with an illustrative embodiment.
Figure 6:
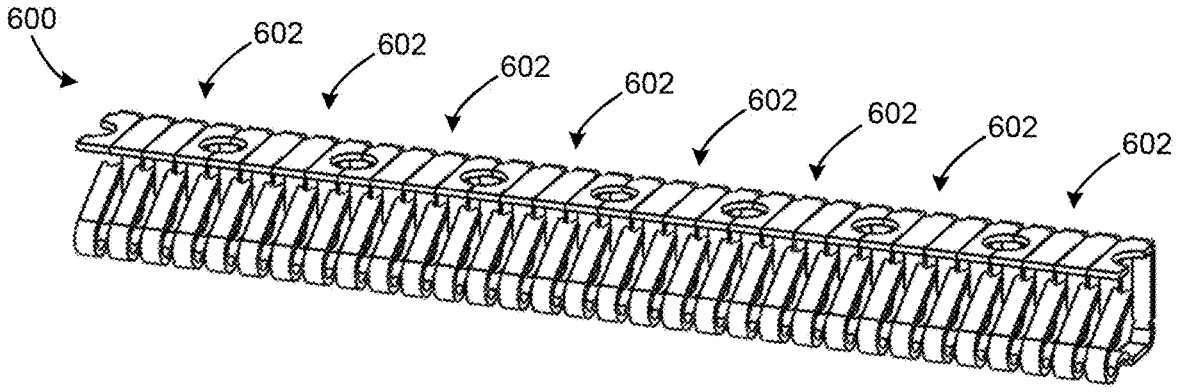
FIG. 6 depicts a perspective view of spring contacts in accordance with an illustrative embodiment.
Figure 7:
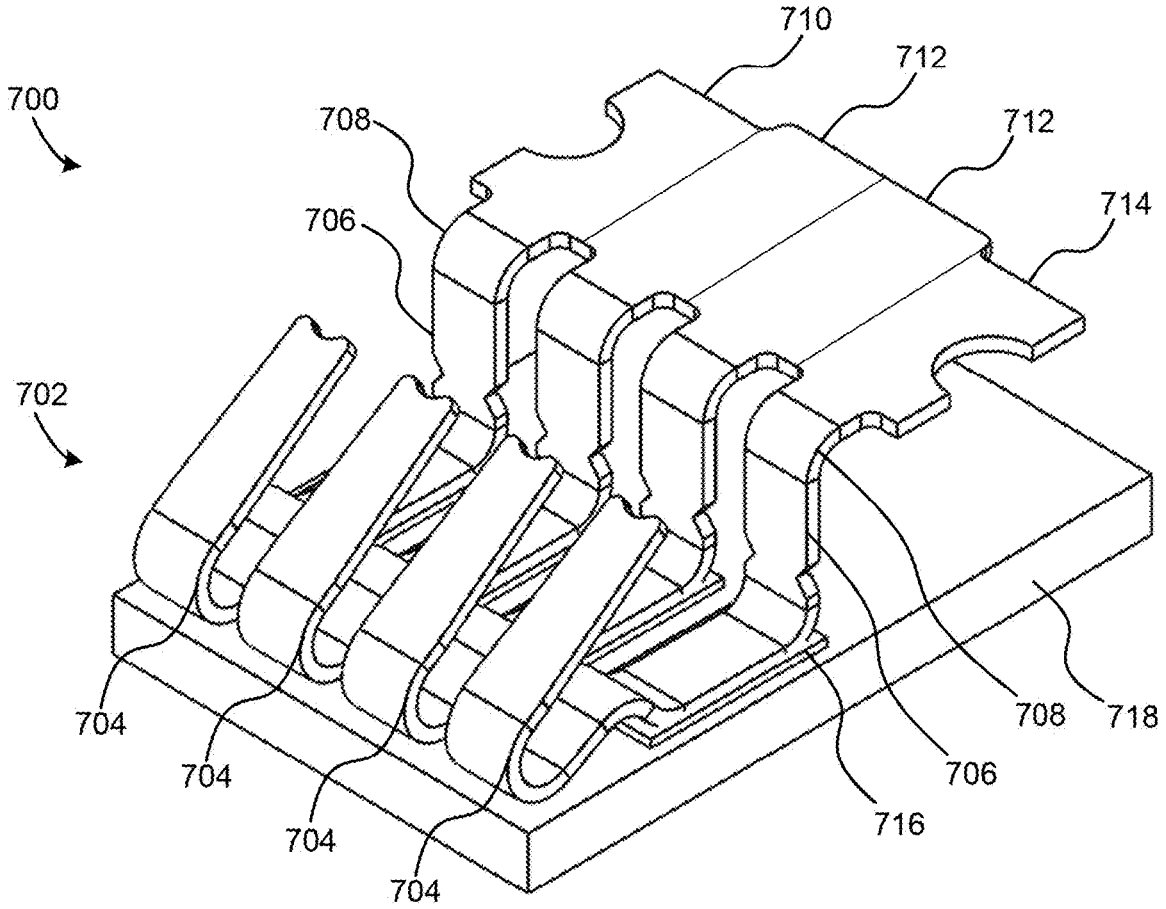
FIG. 7 depicts a perspective view of a mounted spring contact in accordance with another illustrative embodiment.
Figure 8:
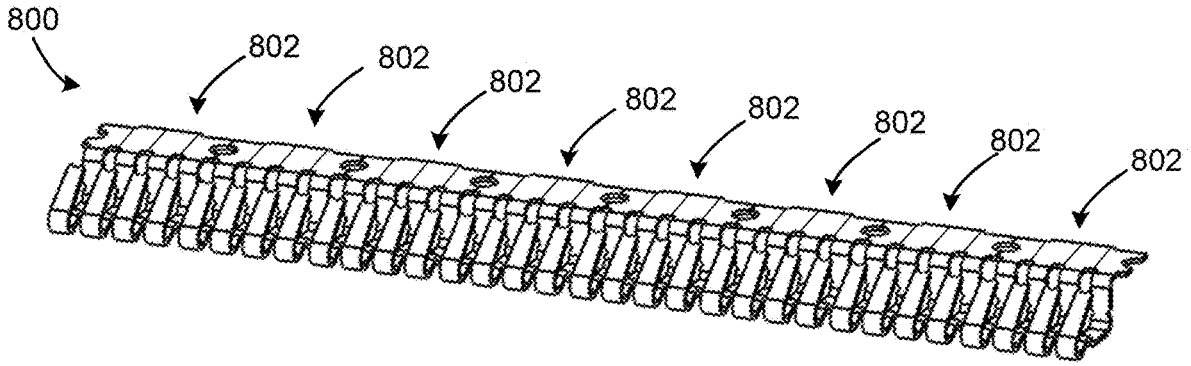
FIG. 8 depicts a perspective view of spring contacts in accordance with another illustrative embodiment.
Figure 9:
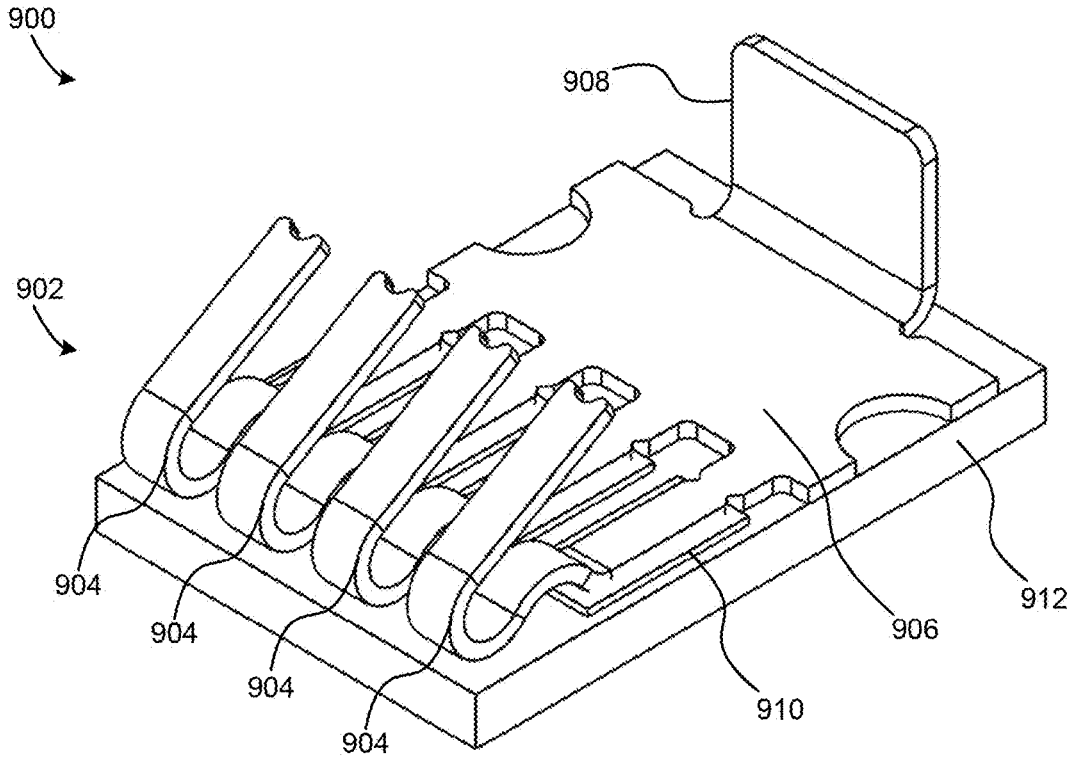
FIG. 9 depicts a perspective view of a mounted spring contact in accordance with another illustrative embodiment.
Figure 10:
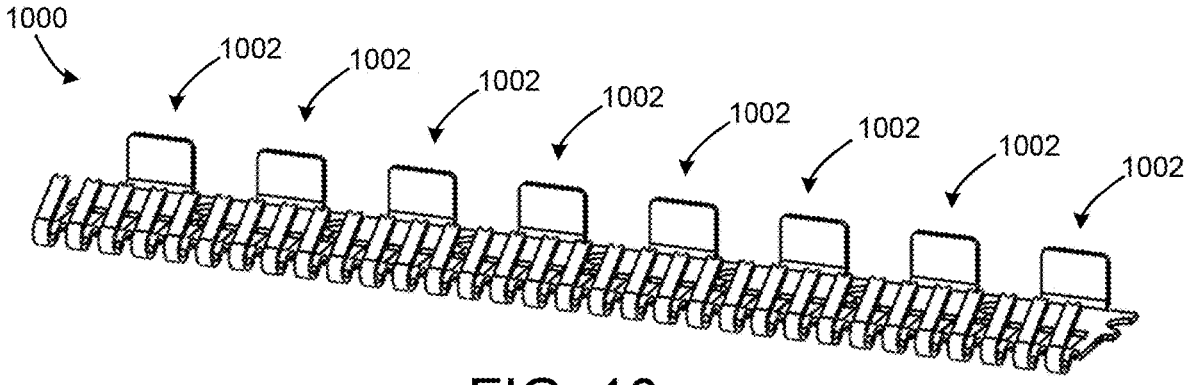
FIG. 10 depicts a perspective view of spring contacts in accordance with another illustrative embodiment.

Referring now to FIGS. 5-10, various embodiments of spring contacts in their shipped configurations are depicted. Specifically, FIGS. 5, 7, and 9 depict spring contact strips mounted to PCBs, while FIGS. 6, 8 and 10 depict the spring contact strips as they appear upon removal from packaging materials. FIG. 5 depicts a perspective view of a mounted spring contact strip assembly 500. Mounted spring contact strip assembly 500 is shown to include a spring contact strip 502 mounted to a PCB 518 using solder pads 516. Spring contact strip 502 may include four spring contacts 504. In various embodiments, spring contact 504 is identical or substantially similar to the spring contact 102, described above with reference to FIGS. 1-3. The spring contact strip 502 is further shown to include a vertical extension portion 506 that is detachably coupled to each spring contact 504. The vertical extension portions 506 are coupled to integral carrier joint portions 508, which are in turn coupled to outer integral carrier portions 510 and 514, as well as inner integral carrier portions 512.

The vertical extension portion 506 may include one or more notch or score features which facilitate detachment of the vertical extension portions 506, integral carrier joint portions 508, and integral carrier portions 510, 512, and 514. Similarly, the integral carrier portions 510, 512, and 514 may include score features to facilitate detachment from each other. However, in various embodiments, outer integral carrier portions 510, 512, and 514 are formed as a single inseparable component.

FIG. 6 depicts a perspective view of a 32-contact strip 600 prior to attachment on a PCB. 32-contact strip 600 may include eight detachably coupled contact strips 602. In various embodiments, contact strips 602 are identical or substantially similar to contact strip 502, described above with reference to FIG. 5.

Turning now to FIGS. 7 and 8, perspective views of an alternate embodiment of a mounted spring contact strip assembly 700 and 32-contact strip 800 are depicted. Mounted spring contact strip assembly 700 is shown to include a spring contact strip 702 mounted to a PCB 718 using solder pads 716. Spring contact strip 702 may include four spring contacts 704. In various embodiments, spring contact 704 is identical or substantially similar to spring contact 102, described above with reference to FIGS. 1-3. In addition, similar to spring contact strip 502, described above with reference to FIG. 5, spring contact strip 702 is shown to include a vertical extension portion 706 that is detachably coupled to each spring contact 704. The vertical extension portions 706 are coupled to integral carrier joint portions 708, which in turn are coupled to integral carrier portions 710, 712, and 714. In contrast to spring contact strip 502, which includes integral carrier portions 510, 512, and 514 extending toward the inclined portions of the spring contacts 504, the integral carrier portions 710, 712, and 714 extend in a direction away from the inclined portions of the spring contacts 704. The orientation of the integral carrier portions 710, 712, and 714 may result in an easier fabrication process for the spring contact strip 702 as compared with the spring contact strip 502. In various embodiments, integral carrier portions 710, 712, and 714 are formed as a single inseparable component. As depicted in FIG. 8, 32-contact strip 800 may include eight detachably coupled contact strips 802. In various embodiments, contact strips 802 are identical or substantially similar to contact strip 702, described above with reference to FIG. 7.

Referring now to FIGS. 9 and 10, perspective views of yet another embodiment of a mounted spring contact strip assembly 900 and 32-contact strip 1000 are depicted. Mounted spring contact strip assembly 900 is shown to include a spring contact strip 902 mounted to a PCB 912 using solder pads 910. Spring contact strip 902 may include four spring contacts 904. In various embodiments, spring contact 904 is identical or substantially similar to spring contact 402, described above with reference to FIG. 4. Spring contact strip 902 is further shown to include an integral carrier portion 906 located in a common plane with the connection portions of the spring contacts 904, and a tip protection portion 908 extending in a vertical direction from the integral carrier portion 906. Tip protection portion 908 may prevent the inclined portions of the spring contacts 904 from being crushed by successive layers of the wrapped strip 902 when packaged in reel form. As shown in FIG. 10, 32-contact strip 1000 may include eight detachably coupled contact strips 1002. In various embodiments, contact strips 1002 are identical or substantially similar to contact strip 902, described above with reference to FIG. 9.

Figure 11:
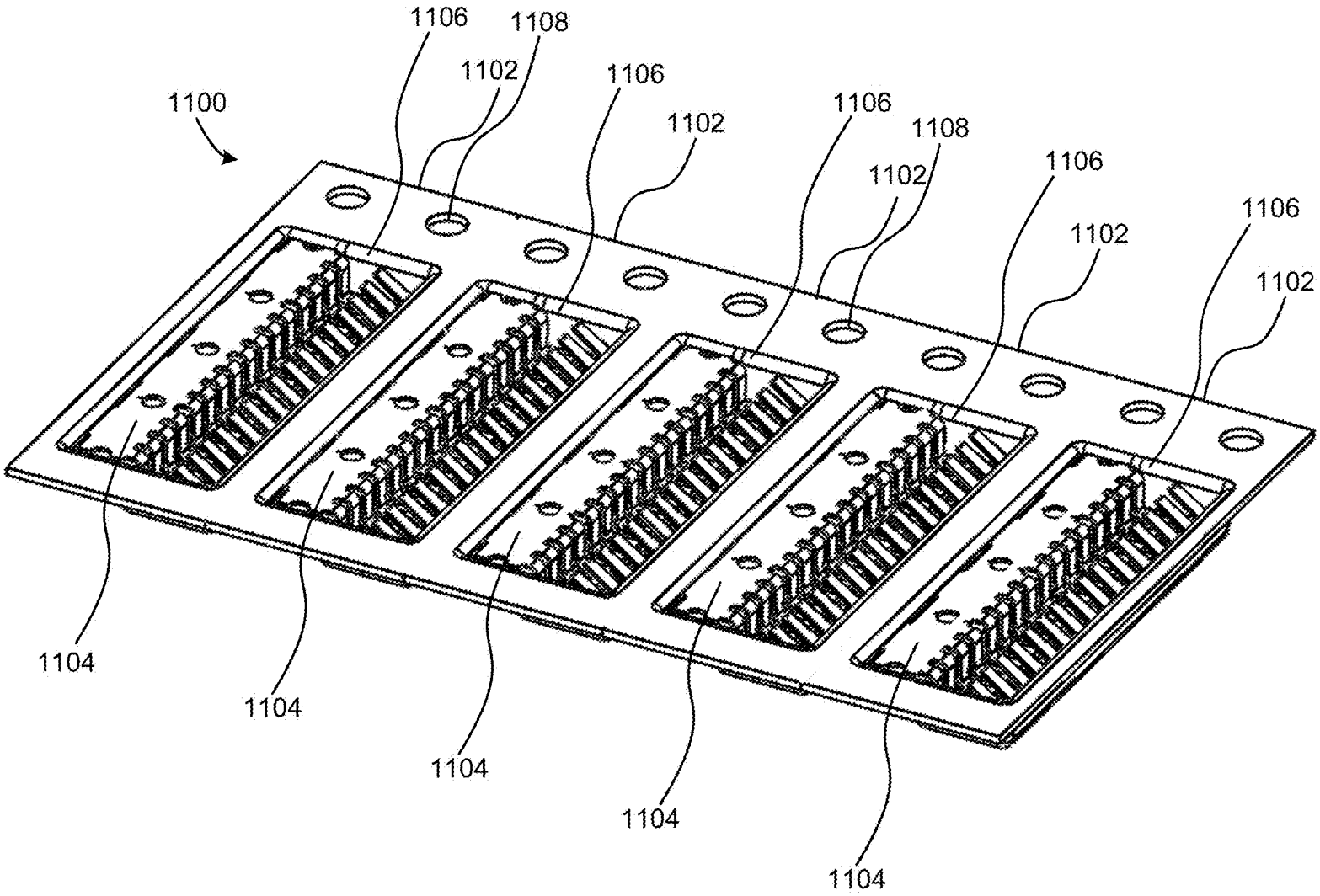
FIG. 11 depicts a perspective view of spring contacts in accordance with another illustrative embodiment.

Referring now to FIG. 11, a perspective view of a spring contact shipping assembly 1100 is depicted, according to an illustrative embodiment. As shown, shipping assembly 1100 is shown to comprise tape and reel packaging with embossed carrier tape segments 1102. In an embodiment, two or more of the carrier tape segments 1102 are formed in a continuous strip. Tape and reel packaging is utilized with automated placement equipment, also known as "pick-and-place" equipment, that is capable of placing thousands of surface mount components on a PCB per hour. Due to their overall length, the spring contact strips of the present application (e.g., contact strips 600, 800, and 1000) may require a multiple-nozzle vacuum pick-up head to maintain flatness over the length of the spring contact strip. In some embodiments, the carrier tape segments 1102 are nominally 44 mm wide.

In order to facilitate the high speed placement of components, each carrier tape segment 1102 is shown to include multiple sprocket holes 1108 that are utilized by a feeder component of an automated placement machine to advance the carrier tape segments 1102 into the machine. Each embossed carrier tape segment 1102 is shown to include a pocket 1106 that partially encapsulates a spring contact strip 1104. The size of pocket 1106 may be chosen such that the contact bodies of spring contact strip 1104 are prevented from excessive movement and damage during handling and storage procedures. In some embodiments, contact strips 600 and 800 may be packaged in tape segments with an 8 mm tape pocket pitch, while contact strips 1000 may be packaged in tape segments with a 12 mm tape pocket pitch.

Figure 12:
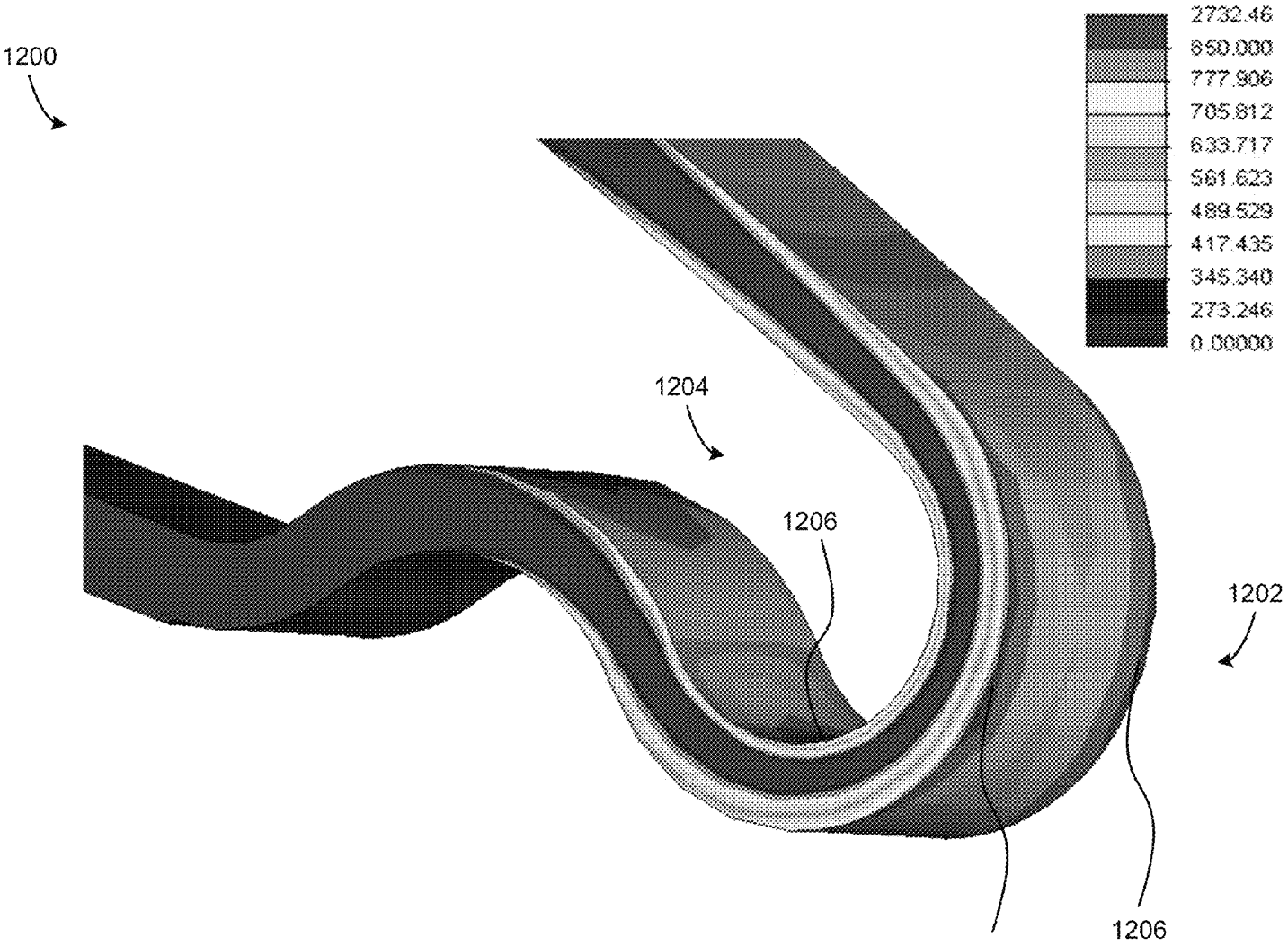
FIG. 12 depicts a plot of the von Mises stress experienced by a spring contact experiencing a deflection load in accordance with an illustrative embodiment.
Figure 13:
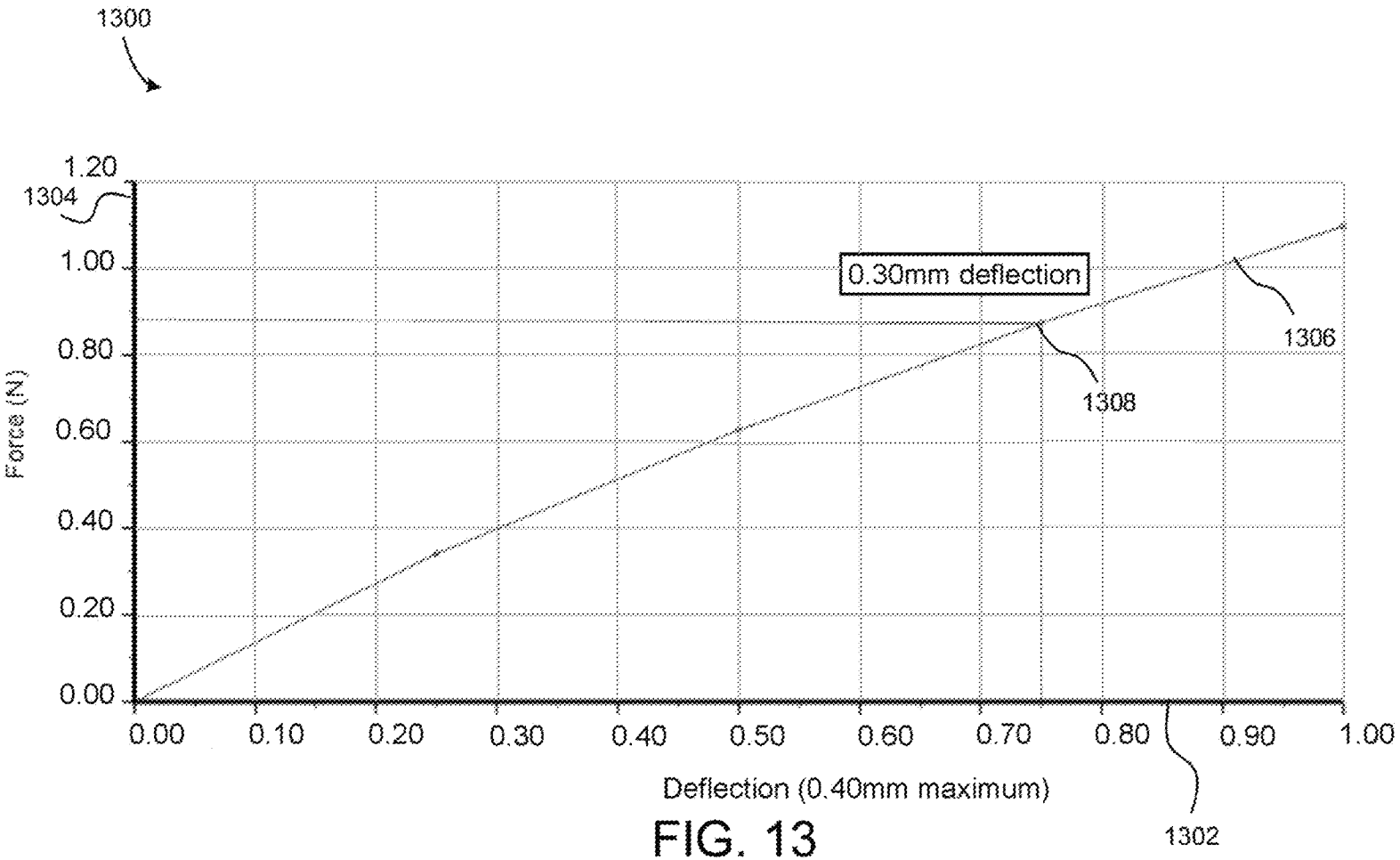
FIG. 13 depicts a plot of the spring contact tip reaction force in accordance with an illustrative embodiment.

FIGS. 12 and 13 depict analytical plots 1200 and 1300 of a spring contact (e.g., spring contact 102, spring contact 402). Plot 1200 depicts a von Mises stress plot of the bend portion of the spring contact caused by a deflection force applied to the inclined portion sufficient to cause a 0.40 mm tip deflection. As shown, areas of high resultant stress may be found on the outer edges 1206 of an exterior face 1202 of the spring contact, as well as the central portion 1206 of an interior face 1204. FIG. 13 depicts a tip reaction force experienced by a nominally 0.15 mm thick BeCu spring contact caused by a tip deflection ranging from 0.00-0.40 mm. The horizontal axis 1302 represents the deflection of the tip of the spring contact as a proportion of a maximum 0.40 mm deflection (e.g., 0.75 on the horizontal axis 1302 is representative of a 0.30 mm deflection). Vertical axis 1304 represents the tip reaction force in Newtons (N). As shown, the relationship 1306 between deflection and tip reaction force is substantially linear, and a 0.30 mm deflection results in an approximately 0.89 N tip reaction force.

Figure 14:
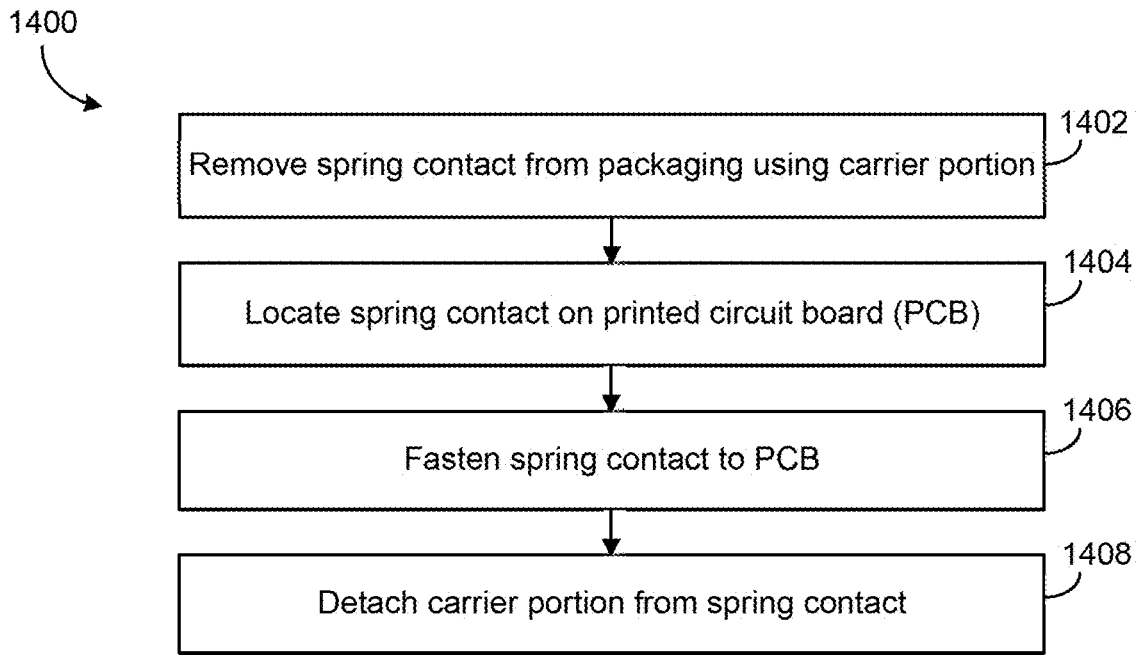
FIG. 14 depicts a method of affixing a spring contact to a PCB in accordance with an illustrative embodiment.

FIG. 14 depicts a method 1400 of affixing a spring contact to a PCB in accordance with an illustrative embodiment. In some embodiments, the method 1400 is performed at least partially by automated placement equipment, described above with reference to FIG. 11. In an operation 1402, a spring contact strip (e.g. spring contact strip 502, 702, 902) is removed from tape and reel packaging. For the purposes of simplicity, method 1400 will be described exclusively with reference to spring contact strip 902. In some embodiments, the tape and reel packaging is identical or substantially similar to embossed carrier tape segment 1102, described above with reference to FIG. 11. For example, the spring contact strip 902 may be removed from the embossed carrier tape segment 1102 by the integral carrier portion 906 and tip protection portion 908 using the gripping mechanism (e.g., a vacuum mechanism, a magnetic mechanism) of the automatic placement equipment.

In an operation 1404, the spring contact strip 902 is located on a PCB. In some embodiments, the PCB is identical or substantially similar to PCB 912, described above with reference to FIG. 9. For example, the connection portions of spring contacts 904 may be positioned to align with the solder pads 910. In an operation 1406, the coupled connection portions of spring contacts 904 and solder pads 910 are further attached to the PCB. In some embodiments, the attachment is completed using a reflow solder process. For example, the spring contact strip 902 and PCB 912 may pass through a reflow oven that heats the assembly and causes the solder pads 910 to melt (i.e., reflow) and wet to the spring contacts 904 and the PCB 912 to form soldered surface mount connections.

In an operation 1408, the integral carrier portion 906 and tip protection portion 908 are detached from the spring contact strip 902. In some embodiments, features of the spring contact strip may aid in the detachment operation. For example, the integral carrier portion 906 and the tip protection portion 908 may be detached from the spring contacts 904. Integral carrier portion 906 may include notches or score features that facilitate the detachment of the integral carrier portion 906 and the tip protection portion 908 from the spring contacts 904.

Figure 15A:
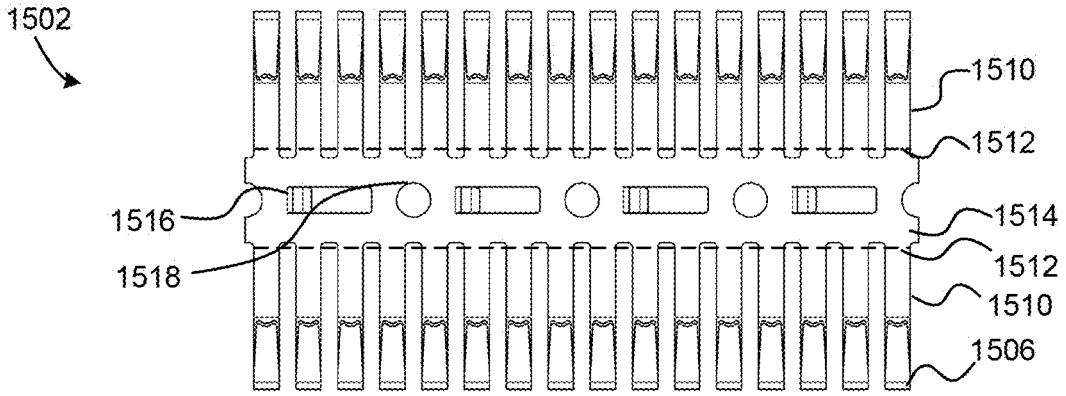
FIG. 15A depicts a top view of the spring contacts in accordance with an illustrative embodiment.

FIG. 15A shows a top view of spring contact strip 1502 in accordance with an illustrative embodiment. The spring contact strip 1502 depicts two mirrored sets of spring contacts 1506 wherein a first plurality of spring contacts 1506 is detachably connected to a first side of an integral carrier portion 1514 and a second plurality of spring contacts 1506 is connected to a second side of the integral carrier portion 1514. Both the first and the second pluralities of spring contacts 1506 are connected to the integral carrier portion 1514 via a detachable coupling portion 1512. FIG. 15A depicts sixteen spring contacts on each side of the integral carrier portion 1514. In alternative embodiments, spring contact strip 1502 may include any number of spring contacts. For example, spring contact 1502 may also include two identical 4-spring contacts, 8-spring contacts, etc. Each spring contact 1506 is attached to the integral carrier portion 1514 via a detachable coupling portion 1512, which is present at an end of a connection portion 1510 of the spring contact 1506. Integral carrier portion 1514 aids in handling and placement of the spring contact strip 1502 and includes a plurality of intermittent tabs 1516 and holes 1518. The tabs 1516 protect the spring contacts 1506 from damage during packaging and storage. The holes 1518 represent a stamping pitch during the spring contact strip fabrication process. In another embodiment, the tabs 1516 and holes 1518 provide a variety of locations along the spring contact strip 1502 to be gripped, hooked, or otherwise manipulated during placement operations. In various embodiments, spring contact 1506 may be identical or substantially similar to spring contact 302, described above with reference to FIGS. 3A, 3B, and 3C. Detachable coupling portion 1512 facilitates selective separation of the spring contacts 1506 after fabrication of the spring contact strip 1502. In an embodiment, the jointed mirroring design of spring contact strip 1502 facilitates fabrication efficiency and reduces the amount of packaging required for a total number of spring contacts.

Figure 15B:
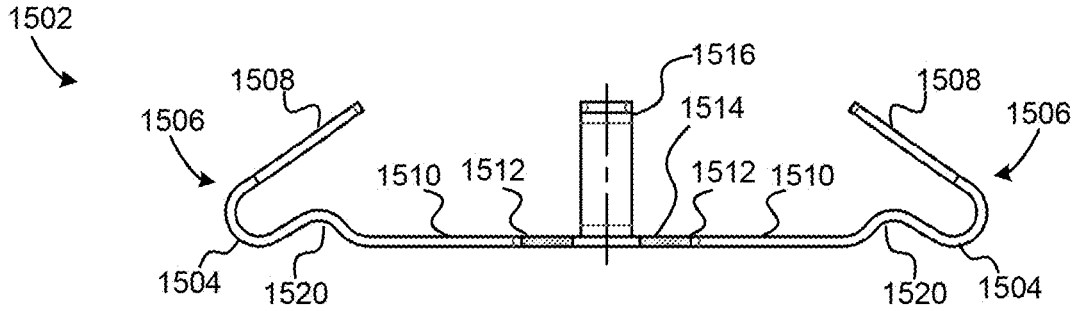
FIG. 15B depicts a side view of the spring contacts in accordance with an illustrative embodiment.

FIG. 15B depicts a side view of the spring contact 1502 in accordance with an illustrative embodiment. In an embodiment, the spring contact 1506 of the spring contact strip 1502 includes an inclined portion 1508, a bend portion 1504, a bulge portion 1520, and a connection portion 1510. As similarly shown in FIG. 15A, an end of the connection portion 1510 is attached to an integral carrier portion 1514 via detachable coupling portion 1512. The detachable coupling portion 1512 allows for selective detachment of spring contacts 1506 from the integral carrier portion 1514. The detachable coupling portion 1512 may include one or more notch or score features which facilitate separation of the spring contacts 1506 from the integral carrier portion 1514. The integral carrier portion 1514 features intermittent tabs 1516 to prevent unnecessary force application to inclined portion 1508 of spring contact 1506 during packaging and storage. In an embodiment, spring contact strip 1502 is wrapped onto a reel after it is stamped, along with a paper inter-leaf to prevent tangling of the contact strip 1502 as successive layers of the contact strip are wrapped.

Figure 15C:
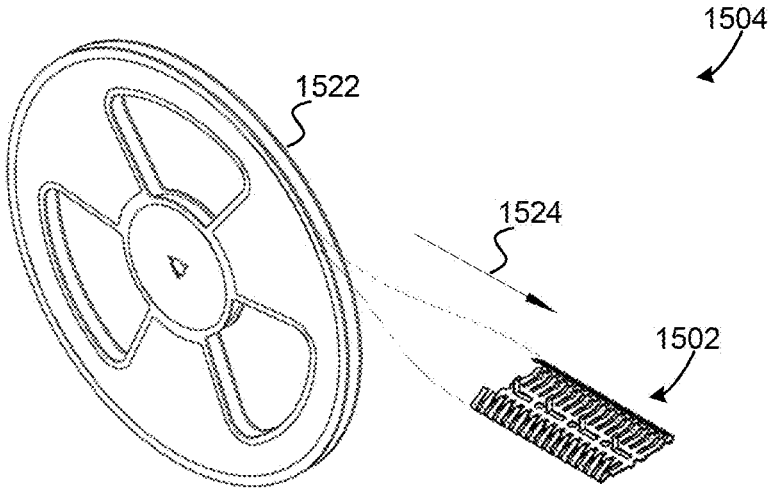
FIG. 15C depicts a perspective view of the spring assembly including a packaging and dispensing system in accordance with an illustrative embodiment.

FIG. 15C depicts a storage and dispensary system 1504 including a storage and dispensing mechanism 1522 that stores and selectively dispenses a spring contact strip 1502 as it mechanism rotates. Upon rotation of the storage and dispensing mechanism 1522, the spring contact strip 1502 is produced in a direction 1524. The storage and dispensing mechanism 1522 facilitates automated pick-up and placement operations. Additionally the storage and dispensing mechanism 1522 may also serve as a shipping container for the spring contact strip 1502. In an embodiment, a user could pull a spring contact strip (similar or identical to spring contact strip 1502) from the storage and dispensing mechanism 1522, attach a vacuum head to each individual spring contact (similar or identical to spring contact 1506) via the connection portion (similar or identical to spring contact 1510), detach the spring contact from the integral carrier portion 1514 via detachable coupling 1512, and place the spring contact on a PCB for soldering.

Figure 16:
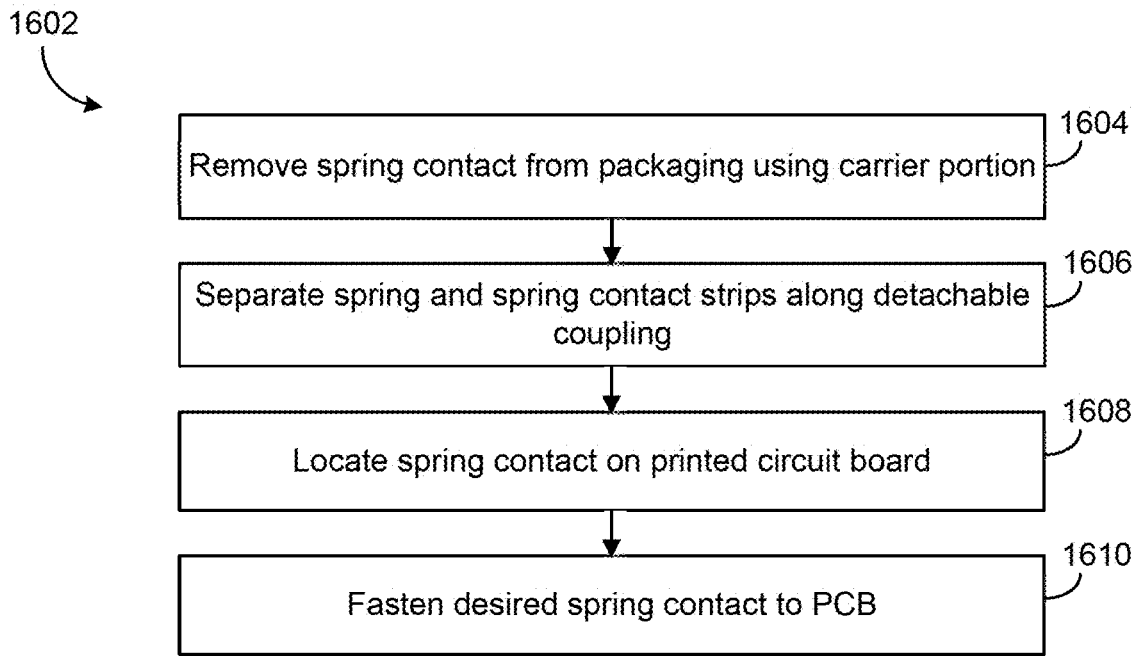
FIG. 16 depicts a method of affixing a spring contact to a PCB in accordance with an illustrative embodiment.

FIG. 16 depicts a method 1602 of affixing a spring contact to a printed circuit board (PCB) in accordance with an illustrative embodiment. In some embodiments, the method 1602 is performed at least partially by automated placement equipment, described above with reference to FIG. 11. In an operation 1604, a spring contact strip (e.g. spring contact strip 302, 1502, etc.) is removed from tape and reel packaging. For the purposes of simplicity, method 1602 will be described with reference to spring contact strip 1502. In some embodiments, the tape and reel packaging may be identical or substantially similar to embossed carrier tape segment 1102, described above with reference to FIG. 11. For example, the spring contact strip 1502 may be removed from the embossed carrier tape segment 1102 such as by the vertical tabs 1516 and holes 1518 featured on the integral carrier portion 1514 using a gripping mechanism (e.g., a vacuum mechanism, a magnetic mechanism) of the automatic placement equipment. In still other embodiments, tape and reel packaging may not be used and other manners of storing and/or dispending the spring contact strip may be used.

In an operation 1606, the spring contact strip from 1502 is separated along one or more score features of a detachable coupling portion. In an operation 1608, the spring contact strip 1502 is located on a PCB. In some embodiments, the PCB is identical or substantially similar to PCB 912, described above with reference to FIG. 9. For example, the connection portions of individual spring contacts 1506 may be positioned to align with solder pads such as solder pads 910. In an operation 1610, connection portions of individual spring contacts 1506 and solder pads 910 are further attached to the PCB. In some embodiments, the attachment is created using a reflow solder process. For example, the spring contact strip 1502 and PCB 912 may pass through a reflow oven that heats the assembly and causes the solder pads 910 to melt (i.e., reflow) and wet to the spring contacts 1506 and the PCB 912 to form soldered surface mount connections.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An electrical spring contact, comprising:

a connection portion configured to couple the electrical spring contact to a printed circuit board;

a bulge portion;

a bend portion having a substantially U-shaped configuration; and an inclined portion extending from the bend portion at an angle relative to a plane that is substantially parallel to the connection portion, wherein the inclined portion comprises a termination having a concave portion configured to receive a single wire termination, and wherein a surface of the concave portion has a uniform radius of curvature;

wherein the connection portion, the bulge portion, the bend portion, and the inclined portion are formed from a single conductive contact material.

2. The electrical spring contact of claim 1, further comprising a hooked portion extending vertically from the connection portion.

3. The electrical spring contact of claim 1, wherein the inclined portion terminates in a forked end configured to receive a single wire termination.

4. The electrical spring contact of claim 1, wherein the single conductive contact material comprises beryllium copper.

5. The electrical spring contact of claim 1, wherein the inclined portion tapers such that a width of the inclined portion decreases as it extends from the bend portion to a distal end.

6. An electrical spring contact strip, comprising:

a plurality of electrical spring contacts, each electrical spring contact comprising:

a connection portion configured to couple each electrical spring contact to a printed circuit board;

a bulge portion;

a bend portion having a substantially U-shaped configuration; and an inclined portion extending from the bend portion at an angle relative to a plane that is substantially parallel to the connection portion;

an integral carrier portion that is detachably coupled to the plurality of electrical spring contacts, wherein the integral carrier portion extends toward the inclined portions of the plurality of electrical spring contacts.

7. The electrical spring contact strip of claim 6, wherein each electrical spring contact further comprises a hooked portion extending vertically from the connection portion.

8. The electrical spring contact strip of claim 7, wherein the integral carrier portion extends away from the inclined portions of the plurality of electrical spring contacts.

9. The electrical spring contact strip of claim 6, wherein the integral carrier portion and the connection portions of the plurality of electrical spring contacts are situated in a common plane.

10. The electrical spring contact strip of claim 6, wherein the inclined portion terminates in a forked end configured to receive a single wire termination.

11. The electrical spring contact strip of claim 6, wherein the plurality of electrical spring contacts and the integral carrier portion are fabricated from a single conductive contact material.

12. The electrical spring contact strip of claim 11, wherein the plurality of electrical spring contacts comprises a first plurality of electrical spring contacts detachably connected to a first side of the integral carrier portion and a second plurality of electrical spring contacts detachably connected to a second side of the integral carrier portion, and wherein the first plurality of electrical spring contacts mirrors the second plurality of electrical spring contacts across the integral carrier portion.

13. The electrical spring contact strip of claim 6, wherein the inclined portion tapers such that a width of the inclined portion decreases as it extends from the bend portion to a distal end.

14. The electrical spring contact strip of claim 6, wherein the plurality of electrical spring contacts comprises four electrical spring contacts.

15. An electrical spring contact strip, comprising:

a plurality of electrical spring contacts, each electrical spring contact comprising:

a connection portion configured to couple each electrical spring contact to a printed circuit board;

a bulge portion;

a bend portion having a substantially U-shaped configuration; and an inclined portion extending from the bend portion at an angle relative to a plane that is substantially parallel to the connection portion;

an integral carrier portion that is detachably coupled to the plurality of electrical spring contacts; and a tip protection portion extending vertically from the integral carrier portion.

16. A system comprising:

a plurality of electrical spring contacts, each spring contact comprising:

a connection portion configured to couple each electrical spring contact to a conductive surface;

a bend portion; and an inclined portion extending from the bend portion at an angle relative to a plane that is substantially parallel to the connection portion; and an integral carrier portion detachably coupled to the plurality of electrical spring contacts;

wherein the plurality of electrical spring contacts comprises a first plurality of electrical spring contacts detachably connected to a first side of the integral carrier portion and a second plurality of electrical spring contacts detachably connected to a second side of the integral carrier portion, and wherein the first plurality of electrical spring contacts mirrors the second plurality of electrical spring contacts across the integral carrier portion.

17. The system of claim 16, wherein the inclined portion on each spring contact tapers such that a width of the inclined portion decreases as it extends from the bend portion to a forked end.

* * * * *